US005902162A

United States Patent [19]

Kot et al.

[11] Patent Number: 5,902,162

[45] Date of Patent: May 11, 1999

[54] COMBINATION PADDLE AND SQUIRT GUN

[76] Inventors: Richard Arn Kot, 16 W. Mission St. Ste. D, Santa Barbara, Calif. 93101; Doyle Wayne Barnett, 535 Barker Pass Rd., Monticito, Calif. 93108

[21] Appl. No.: 08/868,489

[22] Filed: Jun. 3, 1997

[51] Int. Cl.[6] ..... B63H 16/04

[52] U.S. Cl. ..... 440/101; 114/221 R

[58] Field of Search ..... 440/101; 416/69, 416/70, 74; 417/571, 566; 114/221 R

[56] References Cited

U.S. PATENT DOCUMENTS

| | | | |
|---|---|---|---|
| 3,095,825 | 7/1963 | Sandberg et al. | 417/571 |
| 3,165,067 | 1/1965 | Greenwald | 114/211 R |
| 4,133,285 | 1/1979 | Phillips | 440/101 |
| 5,163,778 | 11/1992 | Botero . | |
| 5,322,462 | 6/1994 | Hull et al. | 440/101 |

*Primary Examiner*—Ed L. Swinehart

[57] ABSTRACT

This aquatic sporting device can be used by paddlers of water crafts or boats to paddle their craft or alternately use their paddles as quick-action squirt guns or water cannons with high range and high water exchange rate. The ridged paddle is transformed into a squirt gun by hand turning a nut on the paddle shaft to free the movement of a piston within the paddle shaft, inserting the bottom end of the paddle into the water and then pulling on the paddle handle to draw a central piston several feet out of the outer paddle shaft thereby creating a suction which draws water into the paddle shaft through a nozzle at the bottom end of the paddle blade. The paddle is lifted out of the water and pointed toward the target then the handle is pushed causing the piston to forcefully squirt the water, within the paddle shafts' water chamber, out of the nozzle. The squirt gun can be switched back to paddle mode by pushing the piston back into the outer shaft and re-tightening the central nut. When the piston is fully protracted the paddle can be used as a gaff to pull swimmers toward the boat.

14 Claims, 4 Drawing Sheets

COMBINATION PADDLE AND SQUIRT GUN

BACKGROUND FIELD INVENTION

This aquatic sporting device can be used in several self-powered boating sports, such as canoeing and river rafting in particular where paddling is necessary, where water squirting is desired and also where assistance in retrieval of overboard swimmers is desired.

BACKGROUND PRIOR ART

White water river rafting and canoeing have become very popular sports in recent years. Typically, a raft will have 5 to 15 people on board and be accompanied by one or more other crafts on the river. Usually all of the rafters participate in paddling which can be hard work in fast water. On the calm sections of the river, the rafters often engage in games such as water fights for fun and to help cool themselves after the hard workout. During these fights various members of the opposing rafts will throw water at each other by splashing their paddles, throwing "bailing buckets" of water at opposing crafts or by employing squirt guns and water cannons stowed onboard the craft.

During these water fights, the people participating in squirting and throwing water have the disadvantage of no longer being able to maneuver the raft since they have to set their paddles down to play. Since white water rafting usually involves rough rides it is disadvantageous to carry extraneous items such as buckets, water cannons or squirt guns since they can get in the way of the crews' efforts to paddle on challenging parts of the river and the squirt guns and water cannons can be easily lost over board in rough waters since they cannot be readily secured to the raft and therefore are usually inconveniently stored in secured stuff bags. Miscellaneous items, unsecured, or secured to the raft can also give rise to safety concerns because they can hit or entangle the paddler during passage through rough waters or snag onto rocks or vegetation in the river.

A swimmer is assisted back to the boat by a person in the boat holding the paddle blade and extending the paddle handle to the swimmer. The swimmer grabs the handle and is pulled to the boat. If the swimmer is well out reach of the handle, a rescue can be made by throwing a rope or throw-line.

SUMMARY OF INVENTION

This device is a canoe, raft or other boat paddle that can be used as a big squirt gun with high range and high rate of water delivery and as a gaff for rescuing swimmers. The intention of this device is to provide the boater with a paddle for paddling the boat, a squirt gun for engaging in water fights and other water play and a rescue gaff in one convenient assembly. When a hand-nut on the paddle shaft is loosened an inner piston can be pulled out of the paddle shaft. With the blade of the paddle inserted in the water, the protracting of the paddle shaft creates a suction which sucks up water through a nozzle at the end of the paddle blade into an expanding water chamber within the paddle shaft. With the water chamber full, the user aims the paddle at the target, pushes the piston back into the paddle shaft thereby forcing the water out of the water chamber through the nozzle and out toward the target. This invention also serves as a gaff when the piston is protracted to its limit because the paddle length nearly doubles. The person in the boat can clasp the bladed end of the paddle and offer the handle end of the paddle to a swimmer as far as 10 feet away so the swimmer can be pulled back to the raft.

SUMMARY OF ADVANTAGES

This device can be advantageous to groups of people involved in any of several aquatic sports where there is a need for both a paddle and a squirt gun or a gaff such as boating on lakes or rivers with inner tubes and inflatable mattresses, canoeing or rafting. This device offers the advantage of combining the functions of a high-flow rate, long range squirt gun, a paddle and a gaff in one easy to use device. During water fights one can both paddle and engage in water squirting without having put down one device to pick up another. The water can be squirted and the craft mannered and water squirted again in rapid succession providing more efficient attacks and retreats. This device is more fun than the prior art because of the distinct advantage it offers in water fights. This device eliminates the need for carrying extra device on the boat for squirting down and cooling not only people but also for cooling the air chambers of large rafts when over exposed to the heat of the sun and at risk of bursting. This device adds convenience and safety on rough water by reducing the number of devices that may interfere with the navigation efforts and decrease the likelihood of loosing devices overboard. As a gaff this device also adds a significant safety feature in dangerous water when a boater falls overboard. In this event the paddle transforms into a gaff of nearly twice the paddle length, long enough to reach to the swimmers in their most common proximity's to the boat and pull them back to the boat, where as a simple paddle is often not long enough.

BRIEF DESCRIPTION OF DRAWINGS

In all the figures the thickness of the paddle blade (26), piston (12) wall and paddle shaft (11) wall are not indicated their perimeters are indicated by a simple line or hidden line. Mechanical drawing are included supplement the perspective drawing with additional detail.

REFERENCE NUMERALS IN DRAWINGS

| | |
|---|---|
| 5 | Paddle shaft registration key |
| 6 | Piston registration key |
| 7 | Nut stopper and spinning surface |
| 8 | nut spinning surface mate to 7 |
| 9 | Piston fastening nut |
| 10 | Inside threads of fastening nut |
| 11 | Paddle shaft |
| 12 | Piston |
| 13 | cylindrical shim stopper lip |
| 14 | Threaded end of paddle shaft |
| 15 | Water collimator |
| 16 | Conical acceleration taper |
| 17 | Water chamber |
| 18 | Gasket fastening bolt |
| 19 | Washer |
| 20 | Compression gasket |
| 21 | Suction gasket |
| 22 | Cylindrical shim |
| 23 | Spacer |
| 24 | Piston plug |
| 25 | Paddle blade |
| 26 | Handle |
| 27 | Handle arc |
| 28 | Handle hook |
| 29 | Nut captivation ring |
| 30 | Alternate handle grip |
| 31 | Bonded surfaces of piston and nut stopper |
| 32 | Bonded surfaces of paddle shaft and threaded end |
| 33 | nut surface gripping grooves |
| 34 | Nozzle end |

SPECIFICATIONS

Figures 1A, 1B:
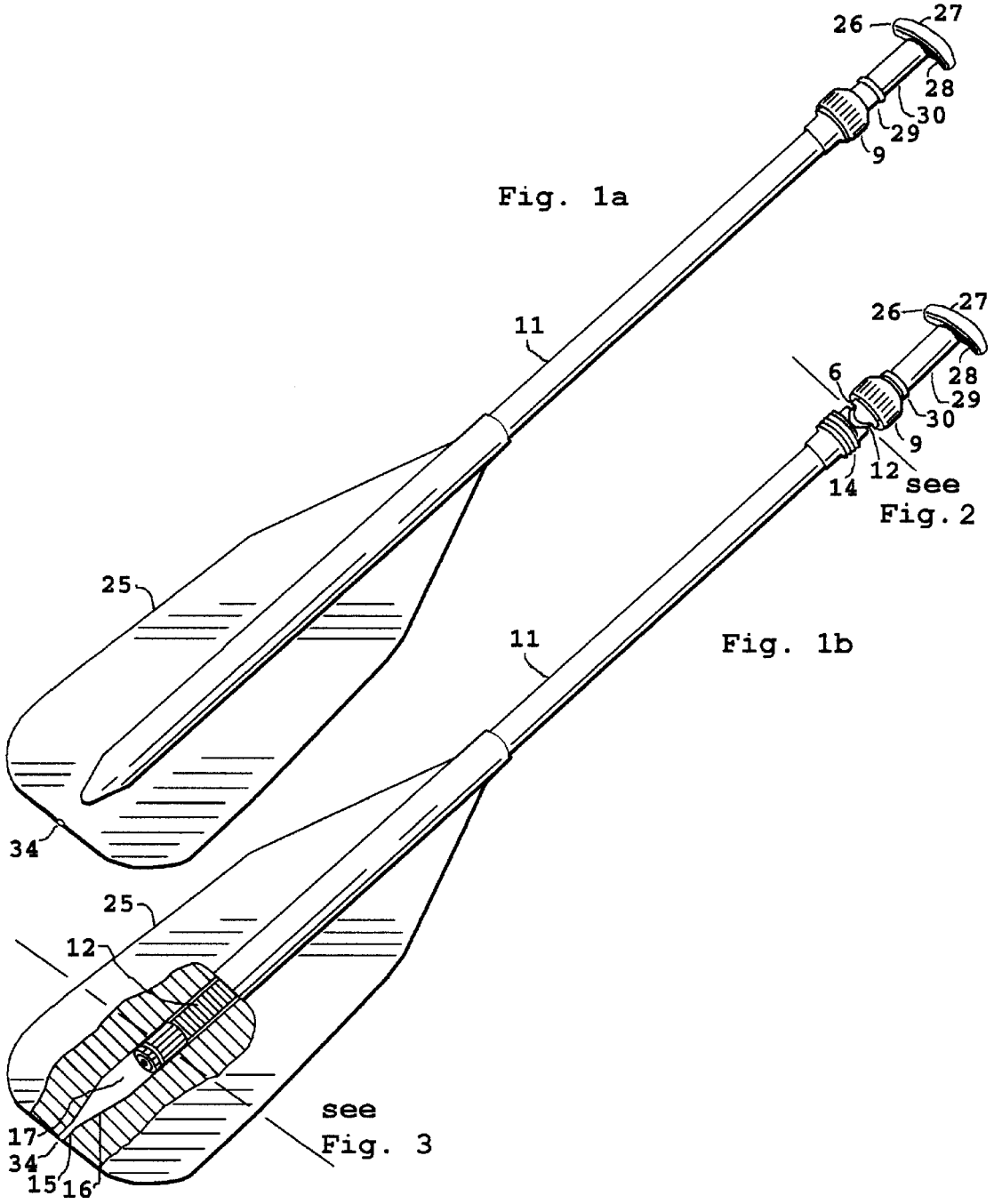
FIG. 1*a* is a perspective view as used as a paddle with the piston shaft locked in place by the locking nut.
FIG. 1*b* is a sectional perspective view with a sectional view through the plane of the paddle blade and paddle shaft axis to reveal the non-sectioned nozzle structure, water chamber and gasket assembly with the combination paddle and squirt gun in an unlocked state operating as a squirt gun, with the piston retracted about 2 inches.
Figure 2A:
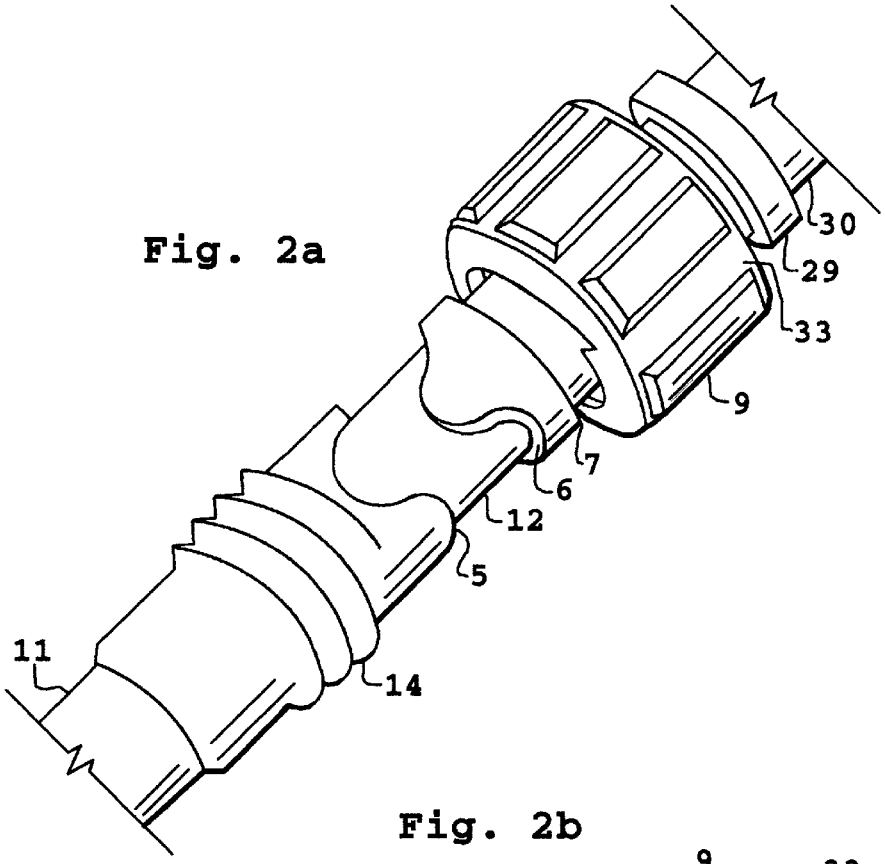
FIG. 2*a* is an expanded perspective view of the paddle shaft threaded end, locking nut with gripping grooves the nut stopper spinning surface, nut captivation ring and piston in the unlocked position with the piston protracted about 1 inch.
Figure 2B:
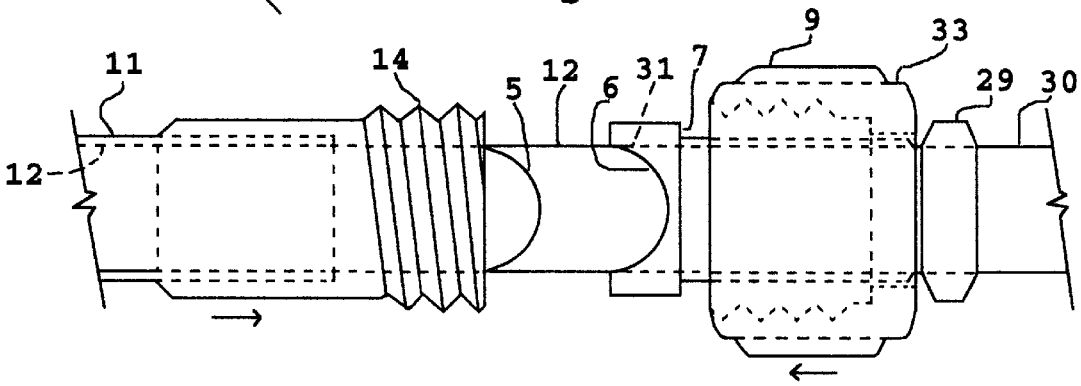
FIG. 2*b* is a mechanical expanded view of the sectioned locking nut and non-sectioned alignment key parts with the piston protracted about 1 inch and the locking nut protracted to the nut captivating ring constituting the unlocked mode as used as a squirt gun with back-side features not shown.
Figure 2C:
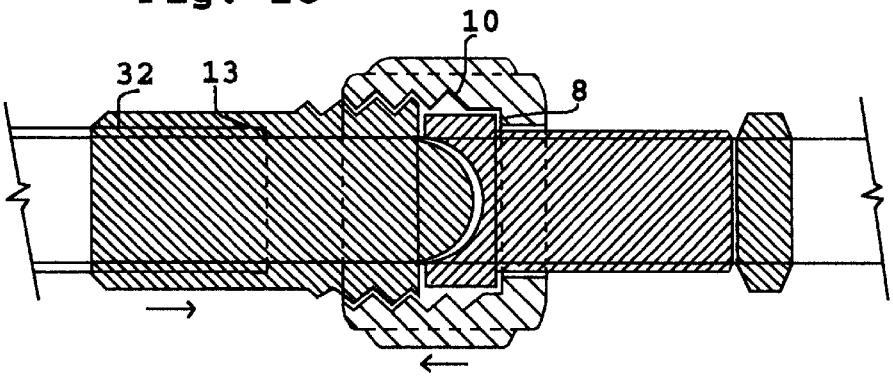
FIG. 2*c* is a sectional expanded view of the locking nut and alignment key parts with the piston retracted to the point where the fastening nut is one half turn from fully tightened and locked for paddling with back-side and hidden features shown and the paddle shaft and piston are not hatched.

In its preferred embodiment the combination paddle and squirt gun, illustrated in Fig. 1*b,* is comprised by a paddle blade (25) of sufficient height and width to deliver ample force against the water when used as a paddle, a paddle shaft (11) and a piston (12), within the paddle shaft, with a top handle (26). The paddle shaft (11) extends through the middle of the paddle blade (25) to a few inches from the bottom of the blade (25). The paddle shaft (11) is connected to the inner piston (12) by a nut (9) and a threaded tube (14). The threaded area (14) is bonded (32) to the paddle shaft. The piston (12) protrudes out of the end of the end of the outer shaft (11) by several inches and is terminated by the top handle grip (26). The top handle grip (26) is aligned to the plane of the paddle blade (25) by a piston self-guiding registration key (6) and an outer shaft key (5) within the locking nut (9) which causes the alignment as the locking nut (9) is tightened. The alignment of the top handle (26) with the plane of the paddle blade (25) is necessary in order for the paddler to know the orientation of the blade (25) to the water by the feel of the handle grip (26) orientation. As illustrated in FIGS. 2*a,* 2*b* and 2*c,* the nut (9) is captivated onto the upper end of the piston (12) by the top handle (26) and the nut stopper spinning surface (7). When the piston (12) is pushed at the handle (26) the piston is retracted all the way into the paddle shaft so that the nut (9) can be threaded onto the threaded upper end (14) of the paddle shaft (11) and tightened. This retracting and tightening causes the nut spinning lip (8) to press against the nut stopper spinning surface (7) thereby compressing the piston key (6) onto the outer shaft key (5) thereby binding the piston (12) to the outer shaft (11) to form a ridged paddle. With fastening nut (9) tightened, the paddle is used, as typical single-ended paddles usually are, with one hand gripping the paddle shaft just above the paddle and the other hand clasping the top handle (26).

When the combination paddle squirt gun is used as a squirt gun, the user unlocks the inner piston (12) from the paddle shaft (11) by loosening the large hand nut (9) at the upper end of the paddle shaft (11). The bladed (25) end of the paddle is placed in the water so that the nozzle (34, 15, 16), consisting of a water collimator (15) and conical acceleration taper (16) and located at the bottom of the blade (25), is submerged. The user clasps the outer shaft (9) with one hand and the top handle (26) with the other. The top handle(26) is pulled causing the piston (12), with air tight gasket assembly (18, 19, 20, 21, 23) to protract, creating a vacuum in the water chamber (17) and thereby drawing water into the lengthening water chamber (17) through nozzle (34). With the outer shaft water chamber (17) now full of water, the user aims the bladed (25) end of the paddle at the target and forcefully pushes on the top handle (26) to push the piston (12) back into the outer shaft (11) thereby forcefully pushing the water out of the nozzle end (34) at high velocity and height delivery rate toward target. The piston (12) is terminated at the lower end with an air tight and water tight gasket assembly, comprising a compression gasket (20), a washer (19), a spacer (23), a suction gasket (21) and a fastening bolt (18), which supports suction at the nozzle end (34) to draw water into the water chamber (17) when the piston is retracted and pressure against the water in the water chamber (17) to force water out the nozzle (34) when the piston (12) is pushed into the outer shaft (11). The piston (12) has a cylindrical shim guide (22) at the lower end which effectively widens the piston (12), slightly, at that point, thereby providing a close fit with the inside of the outer shaft (11). This shim (22) has a smooth surface which guides the movement of the piston (12) within the smooth inner surface of the outer shaft (11). The shim has a diameter greater than the inside diameter of a shim stopper (13) bound at the upper end of the outer shaft (11). This prevents the piston (12) from being pulled all the way out and separating from the paddle shaft (11), since the shim guide (22) will not fit through the shim stopper (13). The roughly two inch length of the shim guide (22) ensures that the piston (12) and outer shaft (11) assembly remain strong when the piston (12) is fully extended. This is because at least this two inches, roughly, length of the piston (12) will remain close fit within the outer shaft (11).

Figure 3:
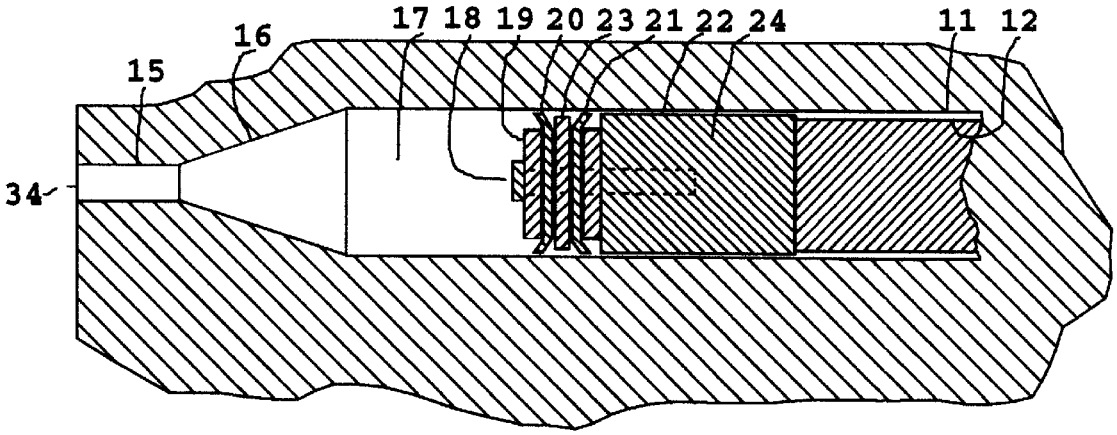
FIG. 3 is a sectional expanded view through the plane of the paddle blade and paddle shaft axis of the piston gasket assembly and nozzle features.

As illustrated in FIG. 3 the nozzle(34,15,16) consists of a conical acceleration gradual taper (16) which provides for non-turbulent laminar water deceleration during water draw and acceleration during squirting, thereby supporting faster water transit. This nozzle also consists of a water collimator hole (15) between the conical taper (16) and the nozzle end (34) at the bladed (25) end of the paddle which is a simple cylindrical hole a few times longer than the hole diameter. This collimator provides for higher-velocity water to exit as a straight, long-range, collimated water jet as opposed to short range conical spray.

Figures 1C, 1D:
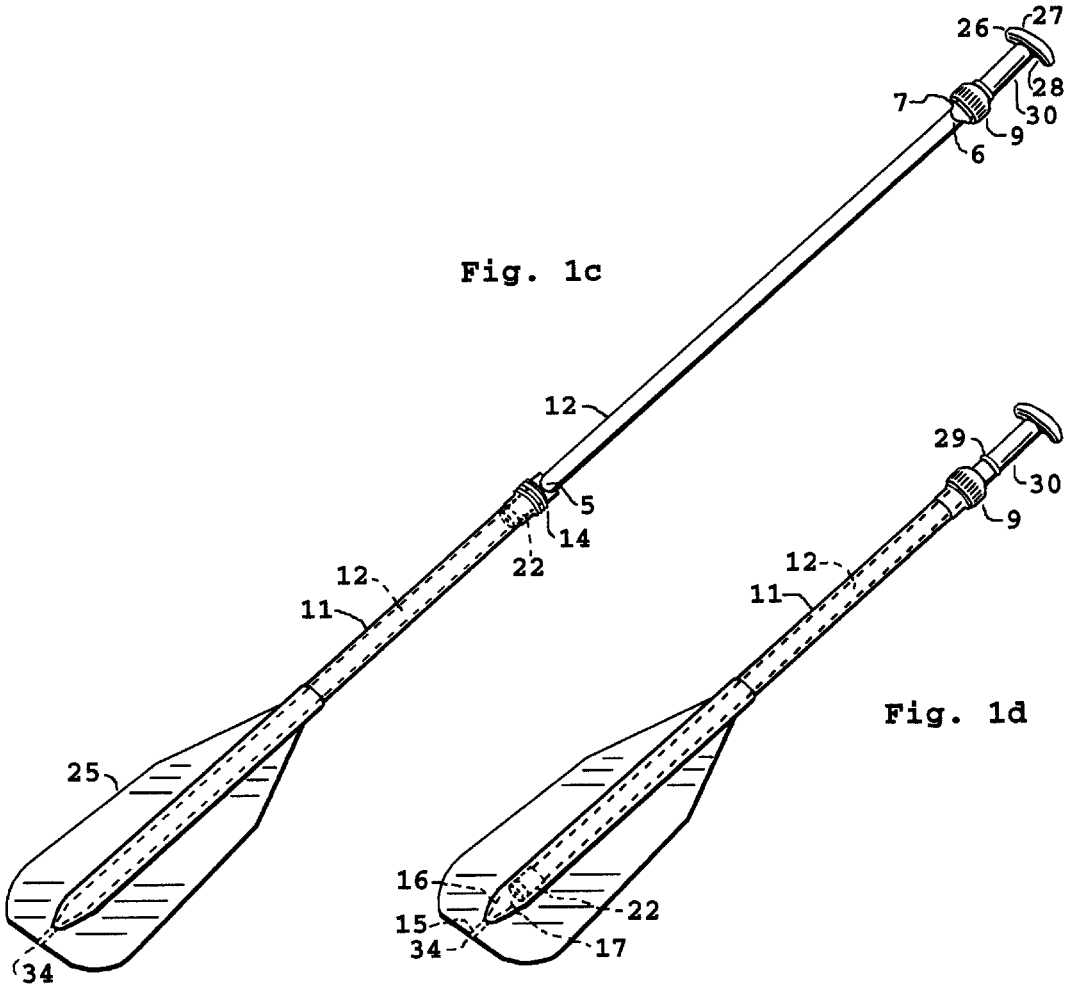
FIG. 1*c* a perspective view showing the fully extended position as used in gaffing or as in the ready-position to squirt a full load of water and the hidden lines showing the expanded water chamber and nozzle.
FIG. 1*d* a perspective view showing the locked position as used during paddling and the hidden lines showing the contracted water chamber and piston and nozzle.

This device can be used as a gaff to assist in retrieving swimmers back to the boat. As illustrated in FIG. 1*c* and 1*d,* when the locking nut (9) is released and the piston (12) is pulled out to its maximum extent, the length of the paddle assembly is nearly doubled in length to about 10 feet. This enables an occupant of the boat to clasp the paddle blade while extending the top handle to a swimmer within 10 feet of the craft. The swimmer can then grab the handle (26) and be quickly pulled into the craft. The top handle (26) has a length roughly equal to a palm width and a width of about 0.5 to 1.0 inches and a wide angle arc (27) on the top side all for grip security and comfort. The top handle (26) underside is slightly arced into a double sided hook shape (28). This hook shape provides comfort while operating as a paddle and where used as a gaff the hook (28) provides a more secure grip for a swimmer being assisted back to the boat. The area between the top handle (26) and the locking nut (9) is used as an alternate handle grip (30) which is made with a soft material of high friction. This area is clasped either by the swimmer during gaffing or by the paddler as a comfortable alternative to the top handle (26) for relieving fatigue.

We claim:

1. A combination boat paddle and squirt gun for functioning as either a boat paddle, squirt gun or water cannon, which can squirt water substantial distances to target, comprising a paddle blade with a converging nozzle, a paddle shaft extending from the paddle blade, a water chamber, a water- and air-tight piston within the paddle shaft and a handle on the piston opposite the blade end.

2. A combination boat paddle and squirt gun of claim 1 wherein the assembly is equipped with a locking mechanism which binds the paddle shaft to the piston to prevent relative motion between the piston and outer shaft.

3. A combination boat paddle and squirt gun, of claim 1 wherein the nozzle is located along the axis at the outside end of the paddle blade providing easy uptake of water and providing line-of-site targeting of the squirting water.

4. A combination boat paddle and squirt gun of claim 1 wherein the piston is equipped with a water and air tight gasket that will slide along the inside length of the paddle shaft providing suction and pressure in the water chamber.

5. A combination boat paddle and squirt gun of claim 1 wherein the converging water nozzle is equipped with a conical taper for reducing water turbulence thereby supporting faster intake and exit flow rates.

6. A combination boat paddle and squirt gun of claim 1 wherein the nozzle is equipped with a cylindrical hole of length a few times the hole diameter for collimating the water squirts thereby providing greater squirt range and reduced conical spraying or dispersion.

7. A combination boat paddle and squirt gun of claim 2 wherein the locking mechanism comprising an affixed outside threaded end on the upper end of the outer paddle shaft, a free spinning nut with captivating lip, captivated on the upper side of the piston and a nut stopper, bonded (11) to the upper end of the inside piston on which the nut spins when tightening and loosening for binding the paddle shaft to the piston to form a ridged paddle body when the said nut is turned and tightened on the paddle shaft thereby compressing the nut stopper against the threaded end of the paddle shaft thereby rigidly binding the piston to paddle shaft.

8. A combination boat paddle and squirt gun of claim 7 wherein the nut has groves (33) in the direction of the axis of the paddle providing gripping friction between the nut and the hand when the nut is either loosened or tightened thereby reducing slippage of the nut clasped in the hand.

9. A combination boat paddle and squirt gun of claim 7 wherein both the threaded end of the paddle shaft and the nut stopper have two 180 degree opposing grooves and tangentially oriented protrusions which together form a key such that the nut stopper fits into the threaded end of the paddle shaft in either of two 180 degree opposing orientations in either of which position provides a means for aligning of the top handle to the plane of the paddle blade thereby providing a means for the user to determine the blade orientation from the feel of the top handle orientation.

10. A combination boat paddle and squirt gun of claim 9 wherein the 180 degree opposing grooves and tangentially oriented protrusions are rounded such that when the upper key and lower key are compressed together and when the opposing keys are not precisely aligned the rounded edges of the opposing keys will contact at an angle, relative to the shaft axis, generating a self guiding twisting force between the two halves of the keys and thereby twisting the paddle blade relative to the top handle until the keys are compressed into self guided alignment at which point the top handle will be aligned to the plane of the paddle thereby assisting in the quick-action transfer from squirt gun mode to paddle mode.

11. A combination boat paddle and squirt gun of claim 9 wherein the relative length of the nut stopper and threaded end of the nut are disposed so that when the top handle and the paddle blade are tangentially oriented and when the inside surface of the nut mates with the nut stopper the two opposing protrusions of the nut stopper extends beyond the threads (10) of the nut as a means for the nut threads to be out of reach of the outer shaft threads until the opposing keys are oriented so that they begin a self-guided twisting slide into each other, toward the locked position, thereby preventing the nut from being tightened until the plane of the paddle blade and the top handle are in self guided alignment thereby ensuring that the plane of the paddle blade and the top handle are aligned when the nut is tightened.

12. A combination boat paddle and squirt gun of claim 1 wherein the upper end of the piston may be used as an alternate handle grip, and be made of soft material of high friction, and poisitioned on the piston directly below the top handle, and being of a diameter roughly equal to the diameter of the outer shaft as a means for providing a comfortable feel of grip while paddling in an alternate grip position wherein the paddle is clasped by the hand just below the top handle.

13. A combination boat paddle and squirt gun of claim 1 wherein the paddle shaft is terminated with inner shaftstopper surface (13), within the paddle shaft, and an inner shaft equipped with a stopper shim on the blade end and a handle on the opposite end providing a limitation to the extent that the piston can be pulled out of the paddle shaft thereby preventing the piston from separating from the paddle shaft.

14. A combination boat paddle and squirt gun of claim 13 wherein the paddle handle shape is hooked or arched toward the shaft as a means for providing the further function of a gaff and an additional grip between a swimmer's hand and the paddle handle when the combination boat paddle and squirt gun is used to pull a swimmer toward the boat.

* * * * *